United States Patent [19]

Hall et al.

[11] Patent Number: 4,623,040

[45] Date of Patent: Nov. 18, 1986

[54] METHOD AND APPARATUS FOR REDUCING ELEVATOR SERVICE CALLS

[75] Inventors: Robert E. Hall, Singer Island, Fla.; Charles Whynacht, Glastonbury, Conn.

[73] Assignee: Otis Elevator Corporation, Farmington, Conn.

[21] Appl. No.: 708,195

[22] Filed: Mar. 4, 1985

[51] Int. Cl.[4] ..... B66B 5/02
[52] U.S. Cl. ..... 187/29 R
[58] Field of Search ..... 187/29

[56] References Cited

U.S. PATENT DOCUMENTS

| | | | |
|---|---|---|---|
| 3,882,969 | 5/1975 | Podcameni et al. | 187/29 R |
| 4,367,810 | 1/1983 | Doane et al. | 187/29 R |
| 4,505,360 | 3/1985 | Tsuji | 187/29 R |

*Primary Examiner*—William M. Shoop, Jr.
*Assistant Examiner*—W. E. Duncanson, Jr.
*Attorney, Agent, or Firm*—Francis J. Maguire, Jr.

[57] ABSTRACT

A method and apparatus for reducing unnecessary elevator service calls by cycling open and shut a nonresponsive car's door, is disclosed. The doors are cycled in the presence of car demand and indications the car door is shut but the hoistway door is ajar. The doors are cycled only after these conditions persist for a selected period.

2 Claims, 2 Drawing Figures

FIG. 1
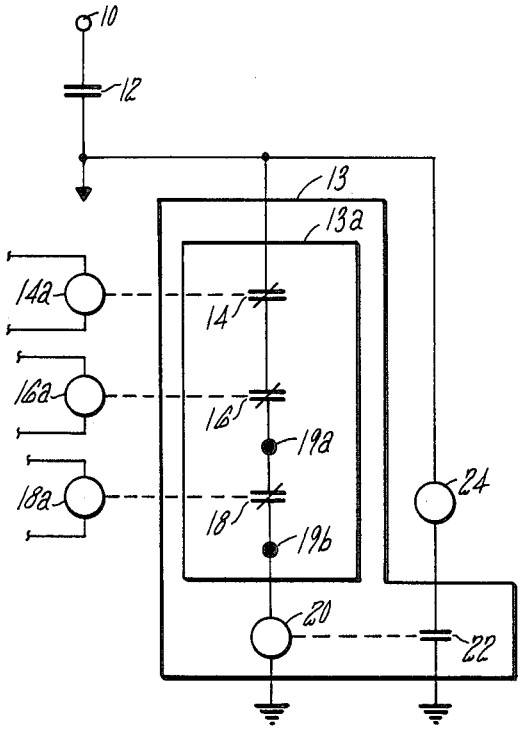
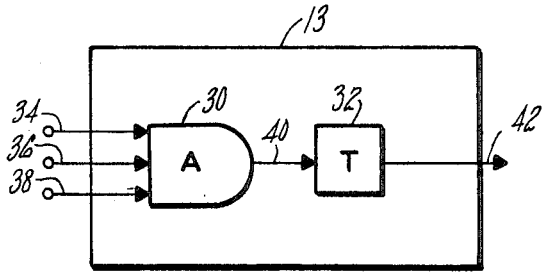
FIG. 2

METHOD AND APPARATUS FOR REDUCING ELEVATOR SERVICE CALLS

TECHNICAL FIELD

This invention relates to elevators, and more particularily to a method and apparatus for reducing unnecessary elevator service calls.

BACKGROUND ART

In many cases elevator field service technicans are unnecessarily dispatched from their service offices due to phantom customer complaints which have dematerialized upon arriving at the building. The elevator is inexplicably found to be in a running condition with the result that the technican logs a "running on arrival" (ROA) on his time log. This results in inefficient deployment of the service force. In addition, unnecessary expenses are incurred by the building owner.

DISCLOSURE OF INVENTION

The object of the present invention is to reduce unnecessary elevator service technican calls due to phantom breakdowns.

According to the present invention, upon detection of a non-responsive elevator car due to an associated elevator hoistway door being ajar, the hoistway door is cycled periodically until the failure is corrected.

The method and apparatus according to the present invention is conceptually based upon the monitoring of the elevator logic for three points. The three points separately indicate that demand exists for a car, the car door is closed, and the presently adjacent hoistway door is ajar. Together they indicate that a car is stuck at a floor due to the failure of the hoistway door at that floor to close completely. If these three conditions continually persist for a selected time interval, a signal is provided, according to the present invention, which will cause the car door and the hoistway door to cycle open and shut.

A failure of the hoistway doors to successfully make-up renders an elevator inoperative due to the safety interlocks of the elevator controller hardware. In many such cases a building owner will discover an inoperative elevator and call the field service office and the problem is corrected by a field service technican. However, in many other cases, the failure is temporary in nature. If the problem is a failure of the hoistway doors to make-up, the doors may make-up before the technican arrives, at which point the elevator is again operative. This might occur if cycling of the hoistway doors occurs in the time before the technician arrives. In general, this would occur as a result of a hall call button actuation by an elevator patron at the floor at which the elevator is stuck. The actuation of the hall call button causes the car door to open and the hoistway door is thereby cycled opened and closed. (The hoistway door is mechanically actuated opened and closed by the action of the car door). Upon reclosing, the hoistway door will most times successfully make-up. Upon arriving at the building, the technican finds the elevator running. This results in the logging of a "running on arrival" (ROA) on the time log of the technican.

The period between cyclings of the hoistway doors, according to the present invention, is relatively short in relation to the normal amount of time generally required for a building owner or maintenance operator to detect a failure of an elevator. Therefore, if the hoistway door "hangup" problem is correctable by cycling, it will normally be corrected, according to the present invention, before the problem is discovered.

It has been found that a dominant failure mode of elevators is the inability of the hoistway doors to successfully make-up and the use of the method and apparatus according to the present invention results in a significant reduction of service calls which reduces the number of ROAs experienced. This translates to increased reliability, customer satisfaction, and economic efficiency.

These and other objects, features and advantages of the present invention will become more apparent in the light of the following detailed description of the exemplary embodiment thereof as illustrated in the accompanying drawing.

BRIEF DESCRIPTION OF THE DRAWING

FIG. 1 is a simplified schematic block diagram of an apparatus for reducing elevator service calls, according to the present invention; and FIG. 2 is an alternate simplified schematic block diagram of another apparatus for reducing elevator service calls, according to the present invention.

BEST MODE FOR CARRYING OUT THE INVENTION

In FIG. 1, a node 10 has a voltage applied thereto for energizing the circuit shown. A normally opened relay contact 12 is closed when the primary safety relay present in an elevator controller is energized. It provides the function of a safety relay circuit which feeds power for the main relay logic of the controller.

Upon closure of contact 12 an apparatus 13 for reducing elevator service calls, according to the present invention, is enabled to monitor a series relay chain 13*a* of contacts 14, 16, 18, respectively called the automatic start relay contact 14, the car door open actuator contact 16, and the hoistway door switch indicator contact 18. Each of these contacts is controlled by corresponding relay coils 14*a*, 16*a*, and 18*a*. Each relay coil is associated with sensing circuitry related to each of the conditions described by the related contacts' nomenclature. The circuitry is not relevant to the inventive concepts disclosed herein and which is therefore not shown.

The automatic start relay contact 14 is a normally closed contact which is closed when the car is commanded to go. The car door open actuator contact 16 is a normally closed contact which is closed when the car door is closed. The hoistway door switch indicator contact 18 is a normally closed contact which is closed when the hoistway door has not made-up or is otherwise ajar.

It should be understood that the circuitry shown in the figure is in simplified form. In addition, each of the various possible implementations would have to take into account the fact that a number of hoistway doors exist within a particular hoistway. Thus, the circuitry shown in the figure may either be replicated for each hoistway door or the hoistway door ajar contact 18 may be changed to a different set of contacts for each particular floor's hoistway door or hoistway door contacts for each floor may be series connected. Thus, a pair of nodes 19*a*, 19*b* are shown to indicate that as the car moves from floor to floor the contacts 18 for particular hoistway doors may be changed by way of substitution according to which floor the car is at. The substitution may be made in any of a number of ways which are not relevant to the disclosure and will not be described. Alternatively, the hoistway door contacts for each floor may be series connected between nodes 19*a* and 19*b*. In that case, which would be expected to be the normally implemented case, a hoistway door ajar at any floor would cause cycling at the floor at which the car is located. However, such an event is extremely unlikely to occur, and if it does occur, is harmless If all three of the contacts 14, 16, 18 are closed, the elevator is in a condition of having a required demand to move from the elevator controller logic but not being able to move due to the failure of a hoistway door to make-up. This is due to the fact that the automatic start relay contact 14 is closed when the car is commanded to go. The car door open actuator contact 16 is closed signifying that the car door is actually closed. The hoistway door switch contact 18 is closed indicating that the hoistway door is ajar. Under this condition a time delay relay coil 20 is energized. This timer is set for a selected time interval, e.g., four minutes. If after the four minute time interval the conditions which caused contacts 14, 16, 18 to close continue to persist, the timer causes an associated contact 22 to close thereby energizing a car door open relay coil. This results in a cycling of the elevator car door and the associated hoistway door at the landing at which the elevator is stuck. Most of the time the hoistway door will then successfully make-up.

Referring now to FIG. 2, an alternate simplified schematic block diagram of an apparatus 13 for reducing elevator service calls, according to the present invention, is illustrated. The apparatus 13 includes an AND gate 30 and timer 32. The AND gate 30 is responsive to a car demand signal on a line 34 indicating that a command-to-go has been issued to a particular car, to a car door closed signal on a line 36 indicating that the particular car door has its door closed, and to a hoistway door ajar signal on a line 38 indicating that the hoistway door is ajar at the landing at which the car is (presumably stuck) at. If all three of the signals on the lines 34, 36, and 38 are simultaneously present at the input of the AND gate 30 it will provide an output signal on a line 40 to the timer 32. The timer 32 provides an output signal on a line 42 only if the signal on the line 40 persists continuously for a selected time period. Thus, in order for the cycling signal on the line 42 to be provided, the signals on the lines 34, 36, and 38 must persist continuously for the selected time interval. The signal on the line 42 is used to cycle the car door and hence the hoistway door open and shut in the expectation that the hoistway door will make-up.

If, after cycling the doors open and shut, the problem continues to persist the timer 32 may be designed to continue to cycle the doors ad infinitum or for a selected number of cycles so that the door opening motor does not burn out. Of course, the timer could be designed to cycle only once during any one given period or intermittent occurrance of a hoistway door ajar signal.

It should be understood that although the invention has been described in a simplified schematic block diagram illustration, actual reduction to practice involves considerably more complexity and may be implemented using the type of relay logic illustrated or other implementations such as electronic timer circuitry, opto-isolated input sensing circuitry, and solid state relays. Use of other such components for different implementations could easily be achieved within the spirit and intent of the invention.

The invention may be designed to be easily interfaced on a retrofit basis for existing installations. Or, the invention may be included in the as-built controller logic of future elevator controller designs.

Similarly, although the invention has been shown and described with respect to an illustrated embodiment thereof, it should be understood by those skilled in the art that the foregoing and various other changes, omissions, and additions in the form and detail thereof may be made therein without departing from the spirit and scope of the invention.

We claim:

1. Apparatus for reducing unnecessary elevator service calls, comprising:

logic means, responsive to a demand signal indicative of a command-to-go issued to an elevator car, responsive to a car door closed signal indicative of said car's door being closed, and responsive to a hoistway door ajar signal indicative of a hoistway door being ajar, said logic means providing an output signal whenever said demand, car door closed, and hoistway door ajar signals are simultaneously presented to said logic means; and timer means, responsive to said output signal for providing a car door open signal for cycling open and closed said car door and said hoistway door only after said output signal has been continuously presented to said timer means for a selected period.

2. A method for reducing unnecessary elevator service calls, comprising the steps of:

determining whether an elevator car has been commanded-to-go, an associated elevator car door is closed, and a hoistway door is ajar; and determining whether each of the conditions determined in the previous step have all persisted simultaneously for a selected period and, if so, causing said elevator car door to cycle open and closed.

* * * * *

UNITED STATES PATENT AND TRADEMARK OFFICE

CERTIFICATE OF CORRECTION

PATENT NO. : 4,623,040

DATED : 11/18/86

INVENTOR(S) : Charles Whynacht et al

It is certified that error appears in the above-identified patent and that said Letters Patent is hereby corrected as shown below:

| | |
|---|---|
| Column 1, line 31. | After "elevator" insert -- controller -- |
| Column 1, lines 49-50. | Cancel "technican" and substitute -- technician -- |
| Column 1, line 61. | Cancel "technican" and substitute -- technician -- |
| Column 1, line 63. | Cancel "technican" and substitute -- technician -- |

Signed and Sealed this

Seventh Day of February, 1989

*Attest:*

DONALD J. QUIGG

*Attesting Officer*

*Commissioner of Patents and Trademarks*